US006957035B1

(12) United States Patent
Giannetti et al.

(10) Patent No.: US 6,957,035 B1
(45) Date of Patent: Oct. 18, 2005

(54) VACUUM ASSISTED FUSER ENTRANCE GUIDE FOR AN ELECTROPHOTOGRAPHIC MACHINE

(75) Inventors: John Giannetti, Penfield, NY (US); Giovanni B. Caiazza, Rochester, NY (US); Jerome F. Sleve, Henrietta, NY (US); Terry N. Morganti, Brockport, NY (US); Brian R. LaBudde, Rochester, NY (US)

(73) Assignee: Eastman Kodak Company, Rochester, NY (US)

( * ) Notice: Subject to any disclaimer, the term of this patent is extended or adjusted under 35 U.S.C. 154(b) by 10 days.

(21) Appl. No.: 10/667,558

(22) Filed: Sep. 22, 2003

Related U.S. Application Data

(60) Provisional application No. 60/412,771, filed on Sep. 23, 2002.

(51) Int. Cl.[7] ..... G03G 15/20
(52) U.S. Cl. ..... 399/322; 271/194; 399/397
(58) Field of Search ..... 399/322, 320, 399/341, 328, 397, 316; 271/194, 195, 196, 271/197; 219/216; 347/156; 430/124, 126

(56) References Cited

U.S. PATENT DOCUMENTS 4,286,863 A * 9/1981 Cornwall et al. ..... 399/322 X
4,378,152 A * 3/1983 Edwards et al. ..... 399/322
4,493,548 A * 1/1985 Ateya ..... 271/195 X
4,566,778 A * 1/1986 Sasaki ..... 399/322 X
4,714,338 A * 12/1987 Iida et al. ..... 219/216 X
5,063,415 A * 11/1991 Ariyama ..... 271/194 X
5,159,394 A * 10/1992 Jinzai ..... 399/322 X
5,515,151 A * 5/1996 Velazquez ..... 399/320 X
6,416,051 B1 * 7/2002 Autz ..... 271/195

FOREIGN PATENT DOCUMENTS

JP 04-032454 A * 2/1992
JP 04-041358 A * 2/1992
JP 04-318880 A * 11/1992
JP 09-281831 A * 10/1997
JP 2001-083825 A * 3/2001

* cited by examiner

*Primary Examiner*—Sophia S. Chen

(57) ABSTRACT

A fuser entrance guide in an electrophotographic apparatus, which supports a sheet of copy medium as it enters the fuser section. The guide has a curved base plate that has vacuum ports both at the edges and across the central area thereof. The ports in the central area are arranged in rows with the exits of all ports in a respective row being fluidly connected by a groove formed in the lower surface of the base plate. The recessed area of the grooves reduce the total contact area of the sheet thereby reducing the drag forces on the sheet but, at the same time, increasing the holding force of the vacuum on the sheet.

14 Claims, 2 Drawing Sheets

VACUUM ASSISTED FUSER ENTRANCE GUIDE FOR AN ELECTROPHOTOGRAPHIC MACHINE

REFERENCE TO RELATED APPLICATIONS

This application claims benefit from the Provisional Application No. 60/412,771 filed Sep. 23, 2002.

FIELD OF THE INVENTION

The present invention relates to a fuser entrance guide for an electrophotographic copier/printer apparatus and in one of its aspects relates to a vacuum assisted guide positioned at the entrance of the fuser section of an electrophotographic apparatus for maintaining the proper alignment of a sheet of copy medium (e.g. sheet of paper) having an unfused image thereon as the sheet moves along a travel path between an image transfer loop (film) and the fuser section.

BACKGROUND OF THE INVENTION

In a typical electrophotographic machine (e.g. copier, duplicator, printer, etc.), a continuous loop of a photoconductor film is commonly used to transfer an image from an input section onto a copy medium (e.g. a sheet of paper or the like). The film is initially charged and passed through an input section where an image is projected onto the charged film. The film then moves through a developing section where toner is applied to the charged image, and on through an image transfer section where the toner is transferred to a sheet of paper or some other medium. The toner (i.e. image) is then fixed (i.e. fused) to the sheet by passing the sheet between a pressure roller and a heated roller within the fuser section of the machine.

In typical electrophotographic machines of this type, it is common to use a vacuum transport to transfer the sheet from the film loop to the fuser section. Often this vacuum transport is directly interfaced between the film and the fuser section wherein the vacuum transport receives the sheet from the film and passes it directly into nip between the rollers in the fuser section. This requires that the surface speeds of (a) the film loop, (b) the vacuum transport belt(s), and (c) the fuser rollers all have to be closely matched. If the speeds become mismatched, there may be relative movement between the film and the sheet while the image is being transferred onto the sheet thereby resulting in smearing of the image on the sheet.

When such relative movement occurs, it is normally at the trail edge of the sheet as the trail edge passes between the image transfer roller and the detack roller since, at this point, the trail edge is held in contact with the film only by electrostatic forces. The speed of the sheet, itself, is controlled by either the speed of the vacuum transport or the speed of the rollers in the fuser section depending on the length of the respective sheet. By matching the vacuum transport belt speed to the film speed, normally there will be no relative movement between the sheet and the film if the length of the sheet is shorter than the straight-line distance between the detack point and the fuser rollers.

However, for sheets longer than this straight-line distance, the sheet will be engaged by the nip between the fuser rollers while the trail edge of the sheet is still engaged between the transfer roller and the detack roller. If this happens, the sheet will move relative to the film and smearing will almost always occur. Therefore, it is imperative that the speeds of these components be synchronized and maintained throughout the entire copy operation.

Unfortunately, due to the dynamic nip mechanics present in all compliant fuser roller(s), the real possibility exists that the speed of the film in the image transfer section and that of the fuser rollers will become mismatched at some time during the copying operation. If and when this occurs, relative movement occurs and smearing appears at the trail edge of the sheet.

To alleviate this problem, some commercial machines have now abandoned any direct interface between the film and the fuser section and instead, use a curved or arched travel path between the image transfer and the fuser sections which is longer than the straight-line distance between these sections (i.e. curved path is longer than the length of any sheet to be used in the copy operations). This extended path effectively "de-couples" the speed of the fuser rollers from the speed of the film thereby eliminating the possibility of relative movement between the sheet and the film.

That is, since the trail edge of any standard sheet used in the machine, up to the maximum length designed for (e.g. up to 17 inches), will be clear of the detack roller before any slack in the sheet is taken out by the fuser rollers, this extended travel path creates a "buffer zone" between the image transfer section and the fuser section. Accordingly, if a speed mismatch should occur, the trail edge of a sheet will be clear of the detack roller before any "overdrive" in a sheet is taken up by the fuser rollers.

Typically, such an extended, curved travel path is provided by angling the vacuum transport away from the straight-line distance between the sections and then positioning a fuser entrance guide between the exit end of the vacuum transport and the entrance of the fuser section. The fuser guide is normally vacuum assisted along the edges thereof so that the sheet is held against the guide to orient the sheet as it enters the fuser section. This type of curved travel path and guides are known and has been commercially used, e.g. DIGIMASTER 9110, Heidelberg Digital L.L.C., Rochester, N.Y.

Where extended travel paths of this type are used, it is particularly important to prevent the trail edge of the sheet from falling away from the fuser entrance guide as the trail edge moves into the fuser section. If this happens, the unfused image on the moving sheet may contact other elements in the paper path before it enters the fuser section thereby again raising the possibility that smearing may occur. In known prior art guides of this type, vacuum ports are provided only near the outer edges of the guide's lower surface. Vacuum force through these ports hold the edges of the sheet against the surface as the sheet moves into the fuser. However, since there is no vacuum being applied against the center of the sheet, the possibility exists that the trailing edge and/or the central portion or the trail edge of the sheet may still sag or droop and contact other elements in the paper path thereby causing smearing at point(s) of contact.

Accordingly, it is highly desirable that the fuser entrance guide be able to hold the entire sheet against the guide without sagging until the sheet has passed completely into the fuser section.

SUMMARY OF THE INVENTION

The present invention provides a fuser entrance guide in electrophotographic apparatus which supports a sheet of copy medium (e.g. paper) as the sheet is moved by a vacuum transport from a continuous loop of film in the image transfer section into the fuser section of the apparatus. The fuser entrance guide includes a base plate that has vacuum ports both at the edges and across the center area thereof. This placement of ports keeps the sheet from sagging or drooping as the sheet moves across the base plate of the guide thereby eliminating the possibility of smearing of the unfused image on the sheet as it enters the fuser section.

More specifically, the present invention relates to a fuser entrance guide for an electrophotographic apparatus, which is comprised of a housing that, in turn, is positioned between the exit end of the vacuum transport and the entrance of the fuser section. The housing is adapted to maintain a vacuum which, in turn, is produced by the Venturi effect created by a stream of air through the housing as will be understood in the art.

The housing has a base plate thereon, the lower surface of which is physically contacted by the sheet as the sheet moves across the guide. The lower surface of the base plate is curved and has a flattened, central area. A plurality of vacuum ports are provided through the base plate with a first set of ports positioned near the outer edges thereof and a second set of ports positioned within the flattened, central area of the plate. Preferably, the ports in the central area are arranged in parallel rows across the flattened area with the exits of all of the ports in a particular row being fluidly connected by a groove, which is formed in the lower surface of the base plate.

The recessed surfaces of the grooves reduce the total surface area, which will be in physical contact with the sheet as the sheet moves across the guide thereby resulting in a significant reduction in the drag forces, which will be applied on the sheet. Also, the recessed area of the grooves effectively increases the holding force of the vacuum applied against the sheet without requiring any increase in the air stream within the guide housing thereby resulting in lower costs as well as improved performance.

BRIEF DESCRIPTION OF THE DRAWINGS

The actual construction operation, and apparent advantages of the present invention will be better understood by referring to the drawings, not necessarily to scale, in which like numerals identify like parts and in which.

While the invention will be described in connection with its preferred embodiments, it will be understood that this invention is not limited thereto. On the contrary, the invention is intended to cover all alternatives, modifications, and equivalents which may be included within the spirit and scope of the invention, as defined by the appended claims.

DESCRIPTION OF THE PREFERRED EMBODIMENTS

Figure 1:
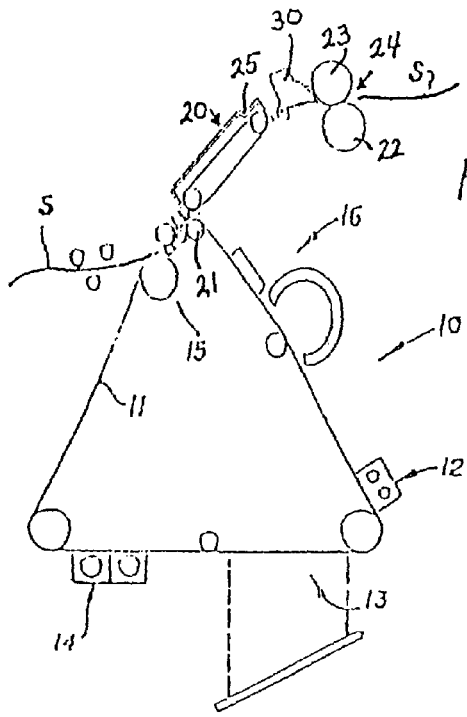
FIG. 1 is a schematic view of an electrophotographic apparatus (e.g. copier/printer machine) in which the present invention is incorporated.

FIG. 1 illustrates a typical electrophotographic apparatus or machine 10 (e.g. copier, duplicator, printer) in which the present invention can be incorporated. Machine 10 is of the type that uses an endless photoconductor member 11 (e.g. photographic film) to transfer a copy of an inputted image onto a sheet of a copy medium. The film moves through a closed loop past a charging section 12, an exposure or input section 13, a developing section 14, an image transfer section 15, and an erase/clean section 16. A sheet S of a copy medium (e.g. paper) is fed from a supply (not shown) through image transfer section 15 where the toner image on the film 11 is transferred to the sheet S. Sheet S is then fed along a travel path 20 from detack roller 21 in the image transfer section 15 to fuser section 24 where the sheet S passes through the "nip" between fusing roller 22 and pressure roller 23 to thereby "fuse" the toner image on sheet S before the sheet exits the machine.

Figure 2:
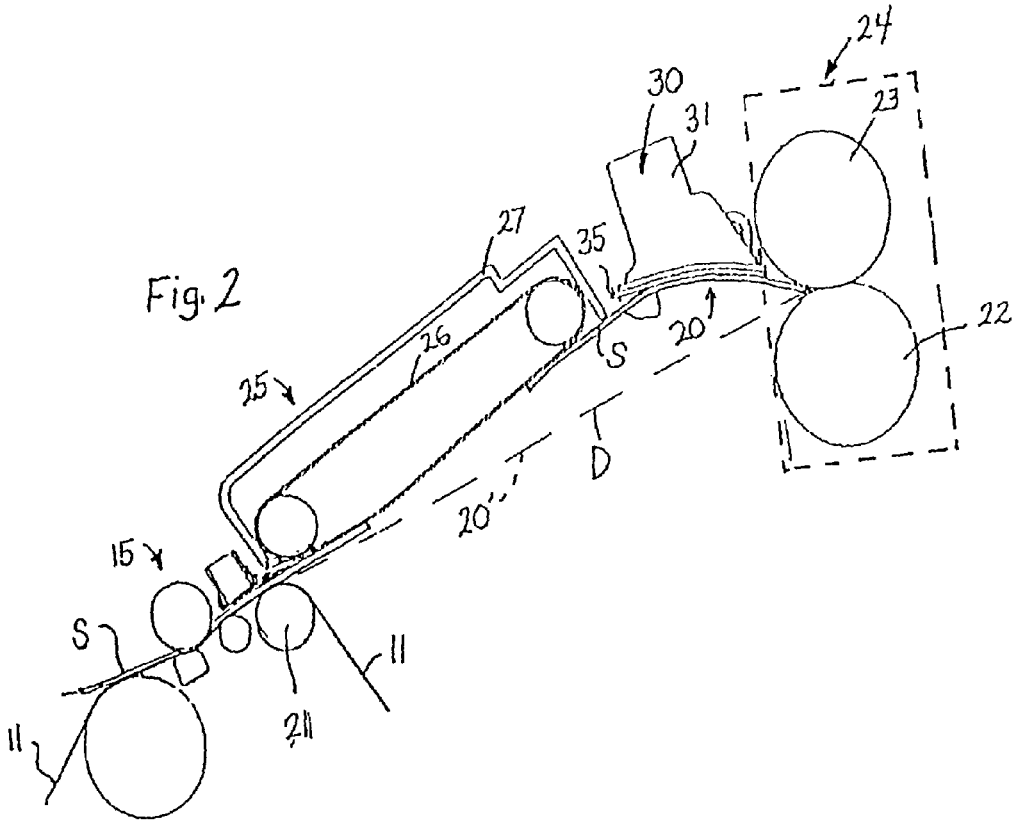
FIG. 2 is an enlarged, cross-section view of the transport path of the apparatus of FIG. 1 having the fuser entrance guide of the present invention incorporated thereon.

FIG. 2 is an enlarged, cross-sectional view of the travel path 20 of the electrophotographic machine 10 of FIG. 1, better illustrating the present invention. Travel path 20 of the present invention is comprised of a vacuum transport 25 of the type well known in this art. Basically, vacuum transport 25 is comprised of endless, perforated belt(s) 26, which moves over a stationary, perforated plate (not shown) within housing 27. As will be understood in the art, a pressurized stream of air (not shown) is flowed through housing 27 to create a vacuum. This vacuum acts through the openings in the plate/belt to hold the sheet against the belt to thereby move the sheet towards the fuser section 24.

In some machines, the vacuum transport 25 provides a direct interface between the image transfer section 15 and fuser section 24. In such machines, the travel path (e.g. travel path 20' in FIG. 2) is equal to the straight-line distance (dotted line D in FIG. 2) between the exit of image transfer section 15 and the entrance of fuser section 24. As explained above, this direct interface requires that the surface speeds of (a) film 11 (i.e. detack roller 21), (b) belt 26, and (c) fuser rollers 22, 23, all be matched in order to prevent possible smearing of the image, especially when the length of sheet S is longer than straight-line distance D.

Since matching and maintaining the speeds of these components is difficult, some recent machines no longer use the vacuum transport as a direct interface between the image transfer section and the fuser section but instead now use an extended, curved travel path 20 which has a length substantially greater than the straight-line distance D between the sections. As seen in FIG. 2, curved travel path 20 is comprised of vacuum transport 25, which is angled with respect to D, and a fuser entrance guide 30, which is positioned, between the exit end of vacuum transport 25 and the entrance into fuser section 24.

Guide 30 provides a "buffer" zone, which effectively "de-couples" the speed of the film 11 from the speed of fuser rollers 22, 23. That is, even though the length of curved travel path 20 may be lightly shorter that the length of the longest sheet used, its curvature allows the trail edge of sheet S to effectively clear detack roller 21 before all of the slack in the sheet is taken up by the nip between the fuser rollers 22, 23. This prevents any relative movement between the film 11 and sheet S when the sheet and the film are in contact with each other, thereby eliminating possible smearing as the toner image is being transferred onto sheet S. Unfortunately, however, there is still a possibility that some smearing may occur if the unfused image on sheet S comes into contact with other elements in the travel path before the trail edges of sheets have safely entered the fuser section 24.

Basically, prior art guide 30' is comprised of a housing 31, which has a curved base plate 35' (FIG. 4), across the lower end thereof. Base plate 35' (FIG. 4) is provided with sets of vacuum ports 32' (only some numbered for the sake of clarity) positioned near the outer edges thereof. Air is passed through housing 31 to create a vacuum which, in turn, is applied through ports 32' to hold the edges of sheet S against the base plate as the vacuum transport 25 moves sheet S towards the fuser section 24. This vacuum acts to keep the engaged edges of sheet S from dropping off the guide as the sheet enters fuser section 24.

Also, base plate 35' has a recessed, flattened area 36' at the center thereof to aid in orienting the ends of the sheets as they pass across base plate 35' and into the fuser section 24. While fuser entrance guides using base plates 35' have proven highly successful in commercial applications (e.g. DigiMaster 9110, Heidelberg Digital, L.L.C., Rochester, N.Y.), the possibility still exists that the trailing edge and/or center of sheet S may sag or droop and physically contact some element in the travel path as the sheet moves across the guide and into the fuser. If and when this occurs, smearing will likely result at that point.

Figure 3:
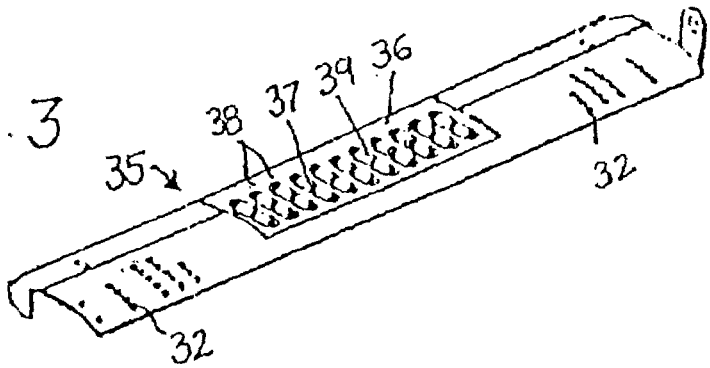
FIG. 3 is a perspective view of the base plate of the fuser entrance guide of FIG. 2.
Figure 4:
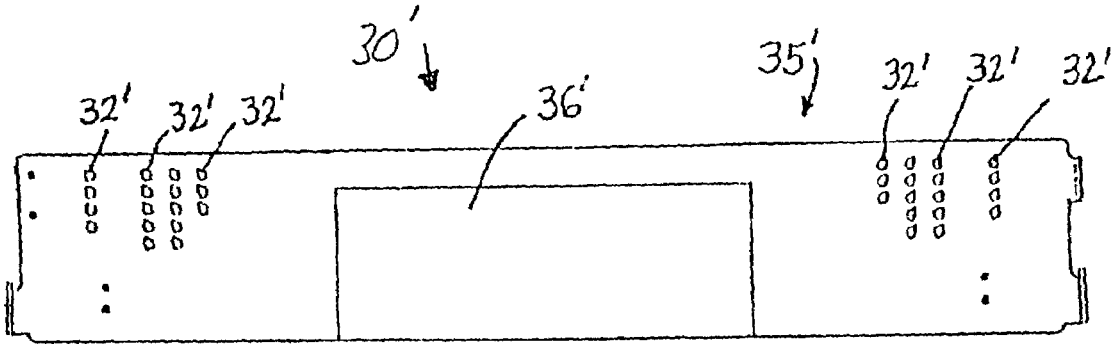
Fig. 4 (Prior Art)
FIG. 4 is an enlarged, bottom view of a base plate for a prior art, fuser entrance guide.
Figure 5:
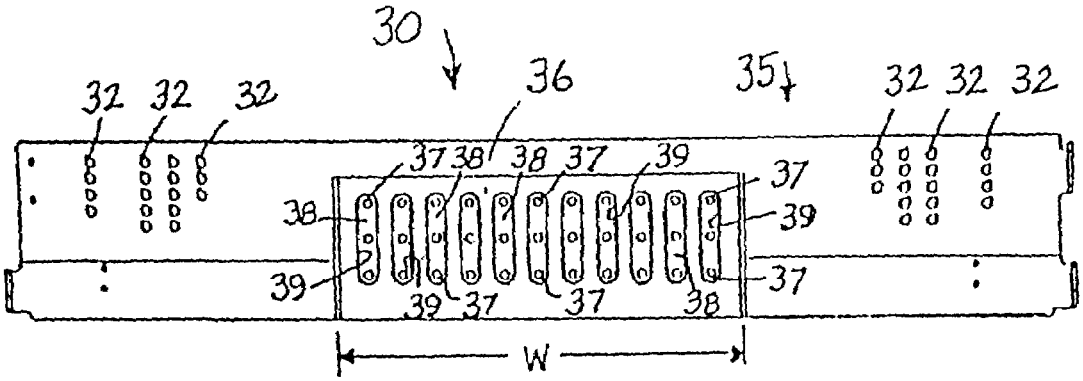
FIG. 5 is an enlarged, bottom view of the base plate of the fuser entrance guide of the present invention.

As can be seen from the drawings, base plate 35 of the present invention (FIGS. 3 and 5) is similar in some aspects to the prior art base plate 35' (FIG. 4). However, the present base plate 35 significantly alleviates, if not eliminates, the possibility that smearing may occurs as the sheet moves across fuser entrance guide 30 and into fuser section 24.

To accomplish this, base plate 35 is provided with a second set of vacuum ports or openings 37 (only some numbered for clarity) within the flatten central area 36 in addition to the first set of vacuum ports 32 which again are positioned near the outer ends of plate 35. This insures that neither the edges nor the central portion of sheet S will sag or droop as the sheet moves across base plate 35.

Basically, the vacuum ports 37, 32 in base plate 35 are sized and positioned so that a sheet S is fully supported on base plate 35 as the sheets moves from the vacuum transport 25 into the fuser section 24. The number and placement of vacuum ports 37, 32 are designed so that the holding force of the vacuum (i.e. force necessary to hold the sheet on the base plate) is balanced against the drag forces produced by the vacuum on the moving sheet. That is, the vacuum applied against the sheet has to be strong enough to hold the sheet in contact with the guide but can not be so strong as to stall or seriously impede the vacuum transport's 25 ability to move sheet S across guide 30 and into fuser 24.

Preferably, vacuum ports 37 are aligned in plurality of parallel rows 38 that, in turn, are spaced across the width W of flattened area 36. For example, as illustrated, eleven parallel rows 38 having three vacuum ports 37 each are provided within flattened area 36 although it should be recognized that the actual size, number of vacuum ports, and number of rows can vary significantly without departing from the present invention as long as the proper vacuum force is provided.

Still further, preferably the exits of all of the vacuum ports 37 in a respective row 38 are connected (i.e. in fluid communication with each other) by a respective, recessed groove 39, which is formed in the bottom surface of base plate 35. The recessed surface of groove 39 of each row 36 substantially reduces the total surface area of the base plate 35 which physically contacts sheet S as the sheet moves across the guide thereby significantly reeducating the drag forces on moving sheet S.

Also, the recessed area of grooves 39 (i.e. connected exits of ports 37) increases the holding force of the vacuum being applied through ports 37 with any given air mover due to the increase in open area on the plate. The holding force is a function of the total open area in the plate as well as the vacuum level provided by the air mover inside the housing 31. A larger amount of open area will produce a larger holding force than will a lesser amount of open area using the same air mover. The size and number of ports will still control the flow through this open area so in effect a smaller flow rate will produce higher holding forces when a recess connects the ports 37.

If the openings 37 were merely enlarged to provide the same open area as that provided by the recesses, the holding forces would be identical but the speed of the airflow through the open area would decrease if the same air mover is used. This is not desirable because the acquisition of the sheet by the guide is a function of air velocity through the open areas. A larger air mover would then be needed to restore the desired air speed. Less open area may then be required to lower the excessive holding forces the larger air mover would produce. The recessed area of the present invention allows a smaller and more economical air mover to be used and still maintain adequate the required air speed and vacuum levels within guide 35 thereby resulting in lower costs as well as improved performance.

By providing fuser entrance guide 30 with the present base plate 35, all routine sizes and weights of paper can be effectively transported from film 11 to the fuser section 24 with assurance that a precise, synchronized speed match between the sheet S and film 11 is not required.

What is claimed is:

1. An electrophotographic apparatus for copying an image onto a sheet of a copy medium, said apparatus having a continuous loop of film for transferring said image to said sheet, a fuser section, and a travel path for transporting said sheet from said film to said fuser section, said travel path comprising:

a vacuum transport for receiving said sheet from said film and moving said sheet towards said fuser; and a fuser entrance guide for receiving said sheet from said vacuum transport and guiding said sheet into said fuser section, said guide comprising:

a housing adapted to maintain a vacuum therein; and a base plate on said housing; said base plate having a lower surface adapted to contacted by said sheet as said sheet moves between said film and fuser section, said lower surface having a first set of vacuum ports positioned near the edges thereof and a second set of vacuum ports positioned within a central area thereof, wherein the exits of some of said vacuum ports in said second set of vacuum ports are fluidly connected together.

2. The electrophotographic apparatus of claim 1 wherein said vacuum ports in said second set are arranged in rows which are spaced across said central area.

3. The electrophotographic apparatus of claim 2 wherein the exits of all of said vacuum ports in each respective row are fluidly connected by a respective groove in said lower surface of said base plate.

4. The electrophotographic apparatus of claim 1 wherein said lower surface of said base plate is curved between said film and said fuser section and wherein said central area in which said second set of vacuum ports are positioned is flattened.

5. The electrophotographic apparatus of claim 4 wherein said vacuum ports in said second set are arranged in rows which are spaced across said flattened area.

6. The electrophotographic apparatus of claim 5 wherein the exits of all of said vacuum ports in a respective row are fluidly connected by a respective groove in said lower surface of said base plate.

7. A fuser entrance guide for an electrophotographic apparatus comprising:

a housing adapted to be positioned between a continuous loop of film and the fuser section within said electrophotographic apparatus, said housing adapted to maintain a vacuum therein; and a base plate on said housing; said base plate having a lower surface adapted to contacted by said sheet as said sheet moves between said film and fuser section, said lower surface having a first set of vacuum ports positioned near the edges thereof and a second set of vacuum ports positioned within a central area thereof, wherein the exits of some of said vacuum ports in said second set of vacuum ports are fluidly connected together.

8. The fuser entrance guide of claim 7 wherein said vacuum ports in said second set are arranged in rows, where are spaced across said central area.

9. The fuser entrance guide of claim 8 wherein the exits of all said vacuum ports in a respective row are fluidly connected by a respective groove in said lower surface of said base plate.

10. The fuser entrance guide of claim 9 wherein said lower surface of said base plate is curved between said film and said fuser section and wherein said central area in which said second set of vacuum ports are positioned flattened.

11. A base plate for a fuser entrance guide for an electrophotographic apparatus comprising:

a plate adapted to be connected to a housing of a fuser entrance guide within said electrophotographic apparatus, said plate having a lower surface adapted to contacted by a sheet of copy medium and having a first set of vacuum ports positioned near the edges thereof and a second set of vacuum ports positioned within a central area thereof, wherein the exits of some of said vacuum ports in said second set of vacuum ports are fluidly connected together.

12. The base plate of claim 11 wherein said vacuum ports in said second set are arranged in rows which are spaced across said central area, and wherein the exits of all of said vacuum ports in a respective said row are fluidly connected by a respective groove in said lower surface of said base plate.

13. The base plate of claim 12 wherein said lower surface of said base plate is curved between said film and said fuser section and wherein said central area in which said second set of vacuum ports are positioned is flattened.

14. A method of guiding a sheet of a copy medium from a vacuum transport in electrophotographic apparatus into a fuser section of said apparatus, said method comprising:

providing a guide between the exit of said vacuum transport and the entrance of said fuser section;

applying a vacuum at both the edges and the central area of the lower surface of said guide to attract and hold the edges and the center of said sheet against said lower surface as said sheet moves from said vacuum transport towards said fuser section; and, reducing the surface area of said lower surface of said guide between some of vacuum ports to reduce drag forces on said sheet moves across said lower surface.

* * * * *